US007163354B2

(12) United States Patent
Runestad

(10) Patent No.: US 7,163,354 B2
(45) Date of Patent: Jan. 16, 2007

(54) CLEANER FINGER ASSEMBLY AND MOUNTING FOR SAME

(75) Inventor: Christopher M. Runestad, Aurora, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/318,339

(22) Filed: Dec. 12, 2002

(65) Prior Publication Data

US 2004/0114999 A1 Jun. 17, 2004

(51) Int. Cl.
*E01C 21/00* (2006.01)
*E01C 19/26* (2006.01)

(52) U.S. Cl. ..... 404/129; 172/606

(58) Field of Classification Search ..... 404/129, 404/122, 124, 117, 121; 172/606
See application file for complete search history.

(56) References Cited

U.S. PATENT DOCUMENTS 1,237,406 A * 8/1917 Stoner ..... 404/129
1,933,679 A * 11/1933 Nicewander et al. ..... 280/855
1,942,655 A * 1/1934 McCormick et al. ..... 280/855
2,108,291 A * 2/1938 McNally ..... 280/855
3,063,177 A * 11/1962 McAdams et al. ..... 172/547
3,085,484 A 4/1963 McAdams et al.
3,183,804 A 5/1965 LeTourneau
3,366,471 A 1/1968 Hill et al.
3,463,063 A 8/1969 Caron et al.
3,554,101 A * 1/1971 Grant et al. ..... 404/129
3,559,545 A 2/1971 Caron
3,598,028 A 8/1971 Grant et al.
3,633,471 A 1/1972 Randour
3,687,023 A 8/1972 Moser et al.
3,718,170 A 2/1973 Caron et al.
3,724,342 A 4/1973 Caron et al.
3,817,645 A 6/1974 Trainor et al.
3,822,957 A 7/1974 Caron et al.
3,853,419 A 12/1974 Bertram et al.
3,891,341 A 6/1975 Trainor et al.
3,922,106 A 11/1975 Caron et al.
3,988,071 A 10/1976 Cochran et al.
4,066,375 A 1/1978 Caron et al.
4,074,942 A 2/1978 Cochran
4,281,945 A 8/1981 Sinkkonen
4,348,134 A 9/1982 Goehler
4,530,620 A 7/1985 McCartney
4,668,122 A 5/1987 Riddle
4,747,588 A * 5/1988 Dillhoff ..... 269/6
4,750,792 A 6/1988 Caron et al.
4,818,040 A 4/1989 Mezzancella et al.
4,865,400 A 9/1989 Caron et al.
4,919,566 A 4/1990 Caron et al.
RE33,312 E 8/1990 Elliot
4,991,662 A 2/1991 Caron et al.
H0946 H 8/1991 Lonn
5,143,359 A * 9/1992 Bush ..... 269/6

(Continued)

*Primary Examiner*—Raymond W. Addie
(74) *Attorney, Agent, or Firm*—James R. Smith; Andrew J. Ririe

(57) ABSTRACT

A work machine, such as a landfill or soil compactor, includes at least one wheel having a plurality of compactor tips. Often, debris or dirt builds up on the wheel between the compactor tips and must be removed. A cleaner finger assembly, including a support member having at least three leg portions and a cleaner finger attached to one of the leg portions is mountable to the work machine. As the wheel rotates, the relatively stationary cleaner finger assembly removes material which would otherwise cause build-up between the compactor tips on the wheel.

20 Claims, 4 Drawing Sheets

U.S. PATENT DOCUMENTS 5,217,321 A 6/1993 Corcoran et al.
5,217,322 A 6/1993 Corcoran et al.
D338,677 S 8/1993 Corcoran et al.
D338,898 S 8/1993 Corcoran et al.
5,330,139 A 7/1994 Tietje
5,330,260 A 7/1994 Freeman
5,358,355 A 10/1994 Brockway
5,360,288 A 11/1994 O'Neill et al.
5,370,451 A 12/1994 Brownlee et al.
5,392,864 A 2/1995 Lindenmuth
D359,054 S 6/1995 Gale et al.
5,451,100 A 9/1995 Freeman
5,466,052 A 11/1995 Tietje
5,553,932 A 9/1996 Freeman
D379,630 S 6/1997 Brockway
5,661,959 A 9/1997 Vargas
5,676,493 A 10/1997 Brockway
5,687,799 A 11/1997 Greenfield et al.
5,713,644 A 2/1998 Freeman
5,733,020 A 3/1998 McCartney et al.
5,769,507 A 6/1998 Brockway
5,795,097 A 8/1998 Caron et al.
5,951,123 A 9/1999 Bomstad et al.
5,967,242 A 10/1999 Caron et al.
5,967,630 A 10/1999 Sewell
5,988,940 A 11/1999 Johansson
6,000,686 A * 12/1999 Yates ..... 269/6
6,042,192 A 3/2000 Brockway
6,045,201 A 4/2000 Chappell et al.
6,045,295 A 4/2000 Puchosic
6,076,843 A 6/2000 Sewell
6,095,717 A 8/2000 Kaldenberg et al.
6,112,650 A * 9/2000 Mazzaccaro ..... 100/110
6,206,611 B1 3/2001 Schreck
6,217,255 B1 4/2001 Knell et al.
6,273,516 B1 8/2001 Brockway
6,290,219 B1 * 9/2001 Barbosa ..... 269/156
6,322,170 B1 11/2001 Knell et al.
D453,940 S 2/2002 McCartney
6,390,204 B1 5/2002 Schafle
6,619,883 B1 9/2003 Livesay et al.
6,632,045 B1 10/2003 McCartney
6,652,186 B1 11/2003 Bierwith
6,682,262 B1 1/2004 Caron et al.
6,712,551 B1 3/2004 Livesay et al.
2002/0114667 A1 8/2002 Kaldenberg et al.
2003/0230867 A1 12/2003 Brockway
2003/0230904 A1 12/2003 Brockway
2004/0012244 A1 1/2004 Waterman et al.
2004/0033107 A1 2/2004 Caron et al.
2004/0081514 A1 4/2004 Livesay et al.
2004/0114999 A1 6/2004 Runestad

* cited by examiner

CLEANER FINGER ASSEMBLY AND MOUNTING FOR SAME

TECHNICAL FIELD

This invention relates to a device which cleans between teeth of a compactor wheel on a work machine and, more specifically, to such a device adapted for mounting on a mounting beam attached to the work machine.

BACKGROUND

Work machines known as compactors are commonly used to compress and spread material, such as trash in a landfill or dirt at a building site. Compactors often have drum-type metal wheels with a plurality of rows of replaceable teeth attached to the outside surfaces of the wheels. The teeth provide traction to the compactor, as well as concentrating the weight of the machine on a small area to increase compression force on the underlying material.

Dirt and debris can become stuck to the wheel between the teeth, particularly in damp conditions or if the soil has a high clay content, such as that found in the southwestern United States. If such debris builds up sufficiently to clog the spaces of the wheel surface between, and roughly to the height of, the teeth, the teeth cannot dig into the ground. Build-up of this severity can cause loss of traction and/or poor compaction.

The generally accepted practice to avoid build-up involves mounting stationary cleaner fingers on a portion of the work machine such that, as the wheels rotate, the cleaner fingers scrape or deflect debris from between the rows of teeth before it has a chance to build up. An example of this type of cleaner finger arrangement is disclosed in U.S. Pat. No. 5,360,288, issued Nov. 1, 1994 to William N. O'Neill et al. (hereafter referenced as '288).

The '288 cleaner finger assembly includes a replaceable cleaner tooth having an arcuate upper surface, a trailing lower surface, and a fastening portion. However, the complexity of the tooth makes it expensive to produce, and the attachment method requires an operator to remove the tooth from below a mounting beam when changing the tooth, which may be an awkward or uncomfortable position for the operator. Additionally, the '288 cleaner finger assembly requires mirror-image cleaner fingers on either side of the wheel, at double the cost of a single system, to provide complete scraping functions when the machine moves both forward and backward because of the angle of the tooth in relation to the wheel.

DETAILED DESCRIPTION

Figure 1:
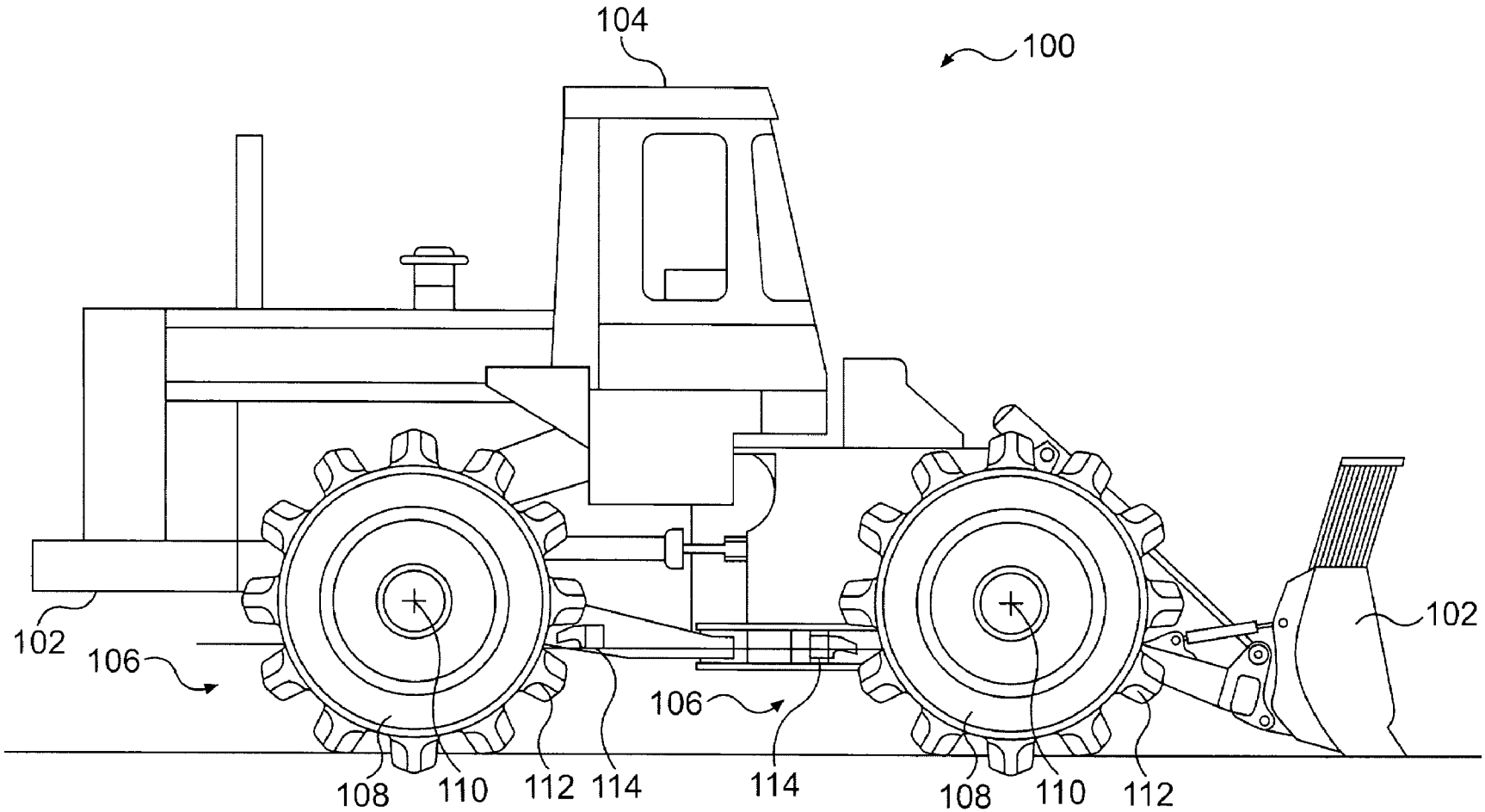
FIG. 1 is a side view of a work machine incorporating an embodiment of the present invention.

Referring first to FIG. 1, a work machine 100 includes a machine body 102, an operator compartment 104 carried by the machine body 102, and a ground-engaging system (shown generally at 106) providing motive power to the machine body 102. The ground-engaging system 106 includes at least one wheel 108 having a wheel axis (shown end-on at 110). At least one compactor tooth 112 is attached to the wheel 108. Preferably, a plurality of compactor teeth 112 are arranged in rows in a known manner. The wheel 108 may oscillate in a known manner as the machine travels. The ground-engaging system 106 also includes at least one wheel cleaner assembly 114 set forth in detail below and including a mounting beam and a cleaner finger assembly 200. The wheel cleaner assembly 114 may be mounted in front of or behind the wheel 108. In addition, multiple wheel cleaner assemblies 114 can be associated with each wheel 108. Furthermore, each wheel cleaner assembly 114 may be mounted at any suitable angle with respect to the wheel axis 110. The configuration shown in FIG. 1 is for exemplary purposes only.

Figure 2:
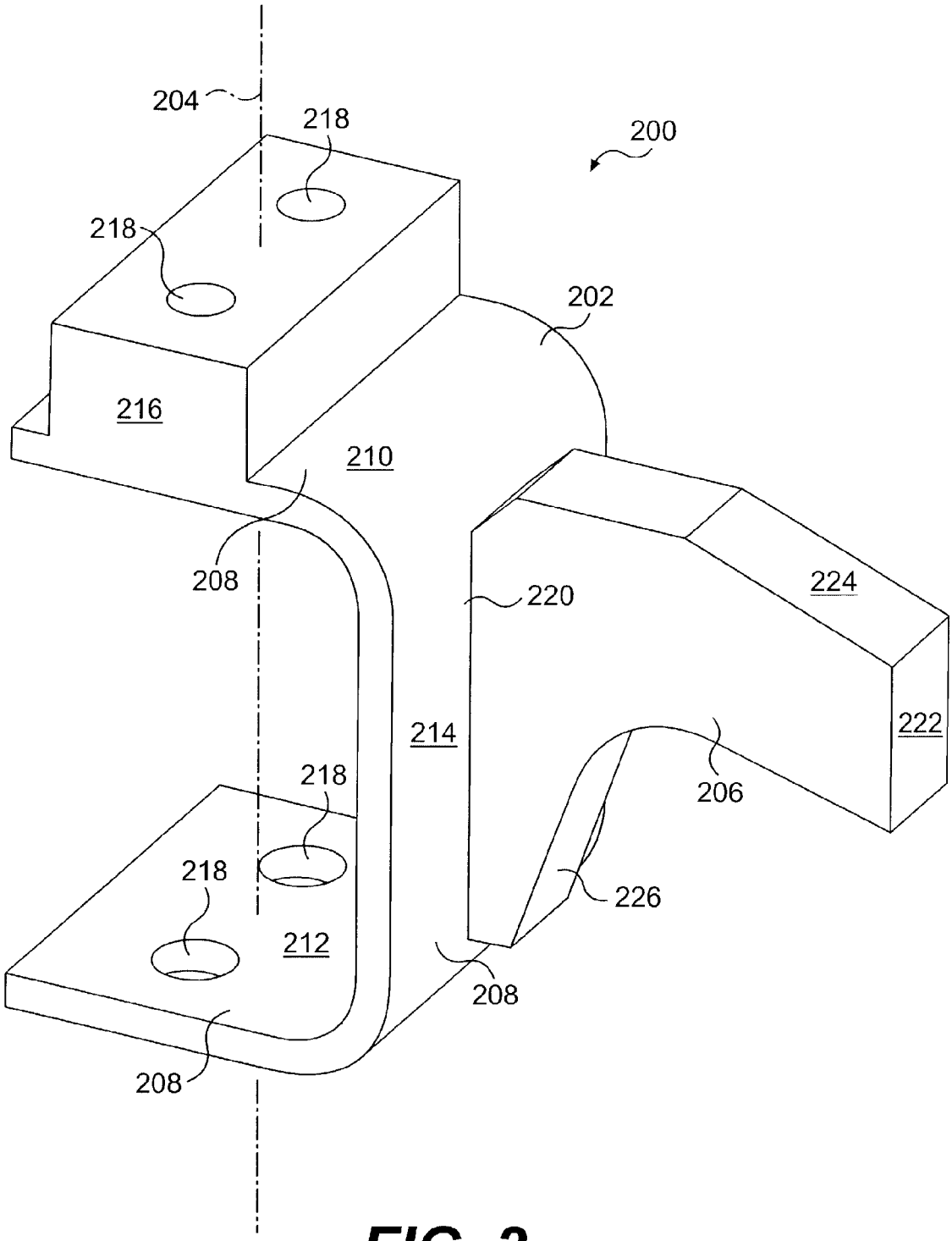
FIG. 2 is a perspective view of a cleaner finger assembly according to an embodiment of the present invention.

FIG. 2 is a perspective view of a cleaner finger assembly 200, which includes a support member 202, which defines a longitudinal axis 204, and a cleaner finger 206. The support member 202 has three or more leg portions 208. By "leg portion", what is meant is a roughly planar piece of material which forms the support member in cooperation with other leg portions. The support member 202 depicted in FIG. 2 has a top leg portion 210 which is substantially parallel to a bottom leg portion 212. The top and bottom leg portions 210,212 are spaced apart along the longitudinal axis 204. A vertical leg portion 214 connects the top and bottom leg portions 210,212, and the cleaner finger 206 is attached to the vertical leg portion 214. Other suitable leg portion 208 arrangements which fall under the scope of the present invention include: a horizontal leg portion connecting two vertical leg portions 214 to one of which the cleaner finger 206 is attached, with the horizontal leg portion being a top or bottom leg portion 210,212 depending upon the orientation of the cleaner finger 206; and an arrangement of four or more leg portions 208, possibly forming a closed structure through which another component can be inserted. The top leg portion 210 shown in FIG. 2 includes a thickened portion, or leg portion extension 216, which may serve a reinforcement or spacing purpose, but is not present on the bottom leg portion 212 shown and is optional for all leg portions 208 in the present invention. Such leg portion extension 216 may be a separate piece, or attached to or formed integrally with the leg portion 208, without departing from the spirit and scope of the present invention. A mounting aperture 218 may be a hole, slot, indent, or the like, and need not extend totally through the thickness of the leg portion 208. The mounting aperture 218 should be operative to receive a mounting fastener (not shown) for attachment of the cleaner finger assembly 200 to another component.

The cleaner finger 206 is optionally attachable and replaceable, for longer life of the cleaner finger assembly 200. Preferably, the cleaner finger 206 is formed and attached to the support member 202 in such a way that the cleaner finger 206 breaks away under excessive force to protect other components of the wheel cleaner assembly 114 from damage. The cleaner finger 206 is intended to be a low-cost part, and as such, is simple in form, having four finger sides and a thickness. If the thickness is substantially uniform in a direction parallel to the longitudinal axis 204 when mounted, the cleaner finger 206 may be easily cut from a sheet of planar stock material.

The four main finger sides are a finger attachment side 220 (adapted to be attached to the support member 202), a finger end side 222 spaced from and substantially parallel to the finger attachment side 220, a finger top side 224 extending between the finger attachment side 220 and the finger end side 222, and a finger bottom side 226 spaced from the finger top side and extending between the finger attachment side 220 and the finger end side 222. Each of the finger sides 220,222,224,226 may optionally include one or more facets, angles, or curves, which would provide the mounted cleaner finger 206 with a nonuniform cross sectional area as taken at varying distances from the longitudinal axis 204.

The finger bottom side 226 is of special interest, as it is preferably curved to provide a concave aspect in a direction perpendicular to the longitudinal axis 204. This concavity is selected to allow for the wheel 108 to oscillate normally without bringing the cleaner finger 206 into contact with the compactor teeth 112, while still leaving sufficient material in the cleaner finger 206 for desired strength and durability. The finger bottom side 226 shown in FIG. 2 is only an example of a suitably concave structure, and one skilled in the art will be able to readily determine an optimal concavity for any particular wheel cleaner assembly 114 in practice.

The positioning of the cleaner finger 206 as attached to the support member 202 may also be chosen for optimal performance. Preferably, the cleaner finger 206 is attached to a longitudinally central area of the leg portion 208 in order to minimize the moment forces transferred to the support member 202 from the cleaner finger 206.

Figure 3:
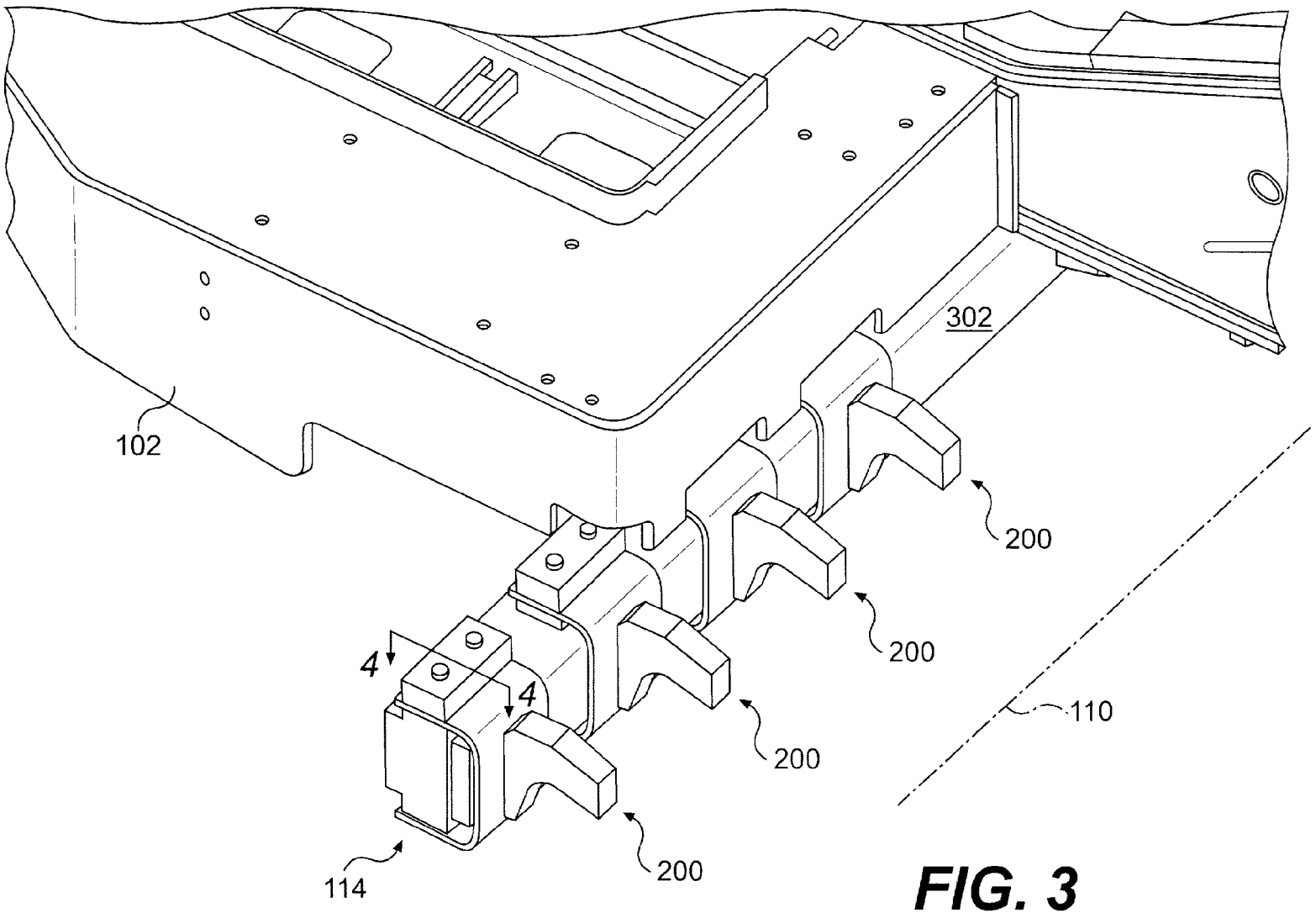
FIG. 3 is a perspective view of a plurality of mounted cleaner finger assemblies according to an embodiment of the present invention.

A preferred mounting of the cleaner finger assembly 200 to the work machine 100 is shown in FIG. 3. The structure depicted is a portion of the wheel cleaner assembly 114 as attached to the work machine 100, with the wheel 108 removed for clarity. The wheel axis 110 provides a visual indication of the usual positioning of the wheel 108.

A plurality of cleaner finger assemblies 200 are removably attached to a mounting beam 302, which is in turn attached to the machine body 102. In a preferred embodiment of the present invention, the mounting beam 302 extends out from the machine body 102 in a direction substantially parallel to the wheel axis 110.

The cleaner finger assemblies 200 are shown in FIG. 3 as being identical, but may be formed or mounted differently from one another along the length of the mounting beam 302 as needed. The mounting beam 302 shown is rectangular in cross-section, but any suitable cross-section, including but not limited to circular, ellipsoid, hexagonal, L-shaped, or the like, may be utilized without departing from the spirit of the present invention. In addition, the mounting beam 302 may be either hollow/tubular or solid, but will be discussed below as being a hollow rectangular beam.

Figure 4:
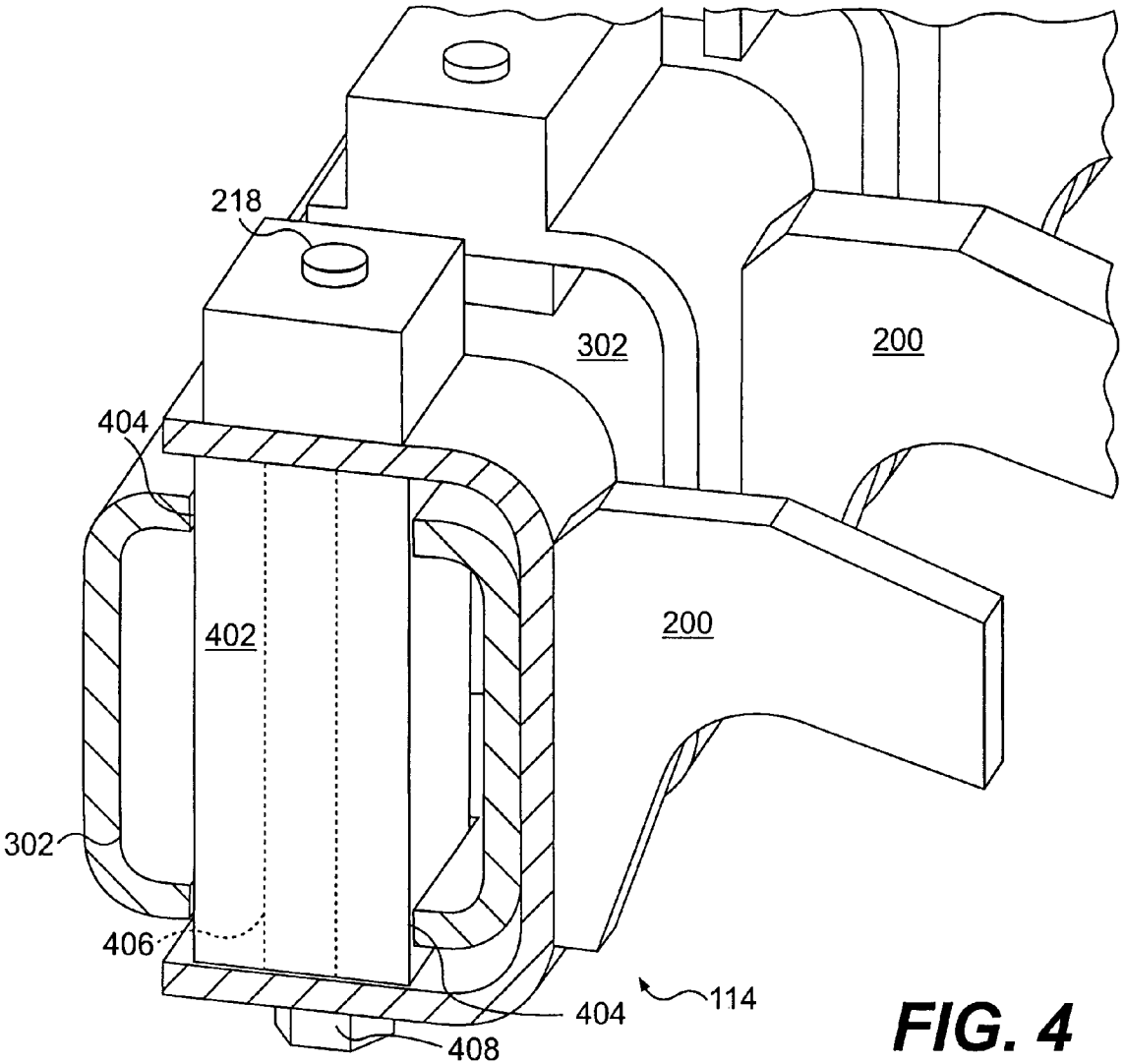
FIG. 4 is a partial perspective and sectional view, taken along line 4—4 of FIG. 3, of a plurality of mounted cleaner finger assemblies according to an embodiment of the present invention.

The attachment of the cleaner finger assemblies 200 to the mounting beam 302 is shown best in FIG. 4, a cross-section through the wheel cleaner assembly 114 taken along line 4—4 of FIG. 3. The support member 202 partially surrounds the mounting beam 302 (in the case of a four or more sided support member 202, the mounting beam 302 may be completely surrounded) and is attached to the mounting beam 302. Though this may be accomplished in any known or suitable manner, the mounting connection depicted in FIG. 4 uses an optional mounting block 402 as an intermediate component to assist with the absorption and dispersal of forces from the cleaner finger assembly 200. The mounting block 402 is inserted through one or more beam apertures 404 formed in the mounting beam 302. The mounting block 402 defines at least one block aperture 406, shown in phantom view. In the embodiment shown in FIG. 4, a mounting fastener 408 is inserted through a first mounting aperture 218 in the support member 202, through the block aperture 406, and through a second mounting aperture 218 in the support member 202 to attach the support member 202 to the mounting beam 302. Many other attachment methods are contemplated by the present invention including those where the beam aperture 404 and/or the block aperture 406 are of any suitable shape and extend partially or fully through the mounting beam 302 and mounting block 402, should one be included, respectively.

INDUSTRIAL APPLICABILITY

As the work machine 100 travels back and forth at the compaction work site, the wheel cleaner assembly 114 stays stationary relative to the work machine 100 while the wheels 108 rotate, bringing the wheels 108 past the cleaner fingers 206 which perform the debris-removal function. Should one or more cleaner fingers 206 become damaged or break away from the support members 202, the operator can supply a replacement cleaner finger 206 and attach it to the support member 202 without having to dissemble the entire wheel cleaner assembly 114. In addition, the operator may use an undamaged cleaner finger 206 or a supplied outline as a template to form a new replacement cleaner finger 206—for example, cutting the cleaner finger 206 from a scrap sheet of steel of the desired type. This allows the operator to eliminate the stocking of spare cleaner fingers 206 and even the necessity of purchasing the cleaner fingers 206 premade, which could lead to substantial cost savings in the operation of the work machine 100.

What is claimed is:

1. A wheel cleaning assembly for a compacting machine comprising:

a bar adapted for extending out in proximity to a wheel of a compacting machine;

the bar having a through aperture formed therein;

a mounting block with a first end and a second end opposite the first end, the mounting block positioned in the through aperture of the bar;

a cleaner finger assembly comprising a cleaner finger for cleaning debris from the wheel; and wherein the cleaner finger assembly is mechanically attached to the mounting block with at least one removable mechanical fastener, and the attachment of the cleaner finger assembly to the mounting block positioned in the aperture prevents the mounting block from being removed from the aperture.

2. A wheel cleaning assembly for a compacting machine according to claim 1 wherein:

the cleaner finger assembly is mechanically attached to each of the first end and second end of the mounting block with the at least one removable mechanical fastener.

3. A wheel cleaning assembly for a compacting machine according to claim 2 wherein:

the mounting block includes a through hole extending from the first end to the second end;

the cleaner finger assembly includes a top leg portion with a through hole and a bottom leg portion with a through hole;

wherein the at least one removable mechanical fastener passes through the through hole of the top leg portion of the cleaner finger assembly, through the through hole of the mounting block, and through the through hole of the bottom leg portion of the cleaner finger assembly.

4. A wheel cleaning assembly for a compacting machine according to claim 1 wherein:

the mounting block has a polygonal cross-section, and the through aperture in the bar has a matching internal cross-sectional shape whereby the mounting block cannot rotate in the aperture when it is positioned therein.

5. A wheel cleaning assembly for a compacting machine according to claim 4 wherein the cleaner finger assembly is attached to each of the first end and second end of the mounting block with at least two removable mechanical fasteners.

6. A wheel cleaning assembly comprising:

at least one cleaner finger assembly comprising:

a "C"-shaped support member having a top leg portion and a bottom leg portion joined together immovably by a vertical leg portion, the top leg portion and the bottom leg portion arranged to face one another and spaced from one another in a first direction "z" to create a space therebetween for accepting a mounting bar;

the space being defined by respective inside surfaces of each of the top leg portion, the vertical leg portion, and the bottom leg portion;

each of the top leg portion, the vertical leg portion, and the bottom leg portion also having respective outside surfaces on an opposite side from the respective inside surface;

a single cleaner finger immovably attached to the outside surface of the vertical leg portion, the cleaner finger extending out from the vertical leg portion in a second direction "y" generally normal to the first direction "z"; and the cleaner finger having a width in a third direction "x" generally normal to the second direction 'y' and the first direction "z", and the vertical leg portion also having a width in a third direction "z", no portion of the cleaner finger being greater in width than the width of the vertical leg portion.

7. A wheel cleaning assembly according to claim 6 wherein the cleaner finger is attached to the vertical leg portion by a weld.

8. A wheel cleaning assembly according to claim 6 wherein the cleaner finger includes a concave side surface adapted to clear debris from between teeth of a compacting machine wheel.

9. A wheel cleaning assembly according to claim 6 wherein the top leg portion includes a first through mounting aperture and the bottom leg portion includes a second through mounting aperture, the first and second through mounting apertures being aligned on a single axis.

10. A wheel cleaning assembly according to claim 9 further comprising a mounting bar assembly positioned in the space of the support member of the at least one cleaner finger assembly.

11. A wheel cleaning assembly according to claim 10 wherein the at least one cleaner finger assembly is at least three cleaner finger assemblies.

12. A compacting machine comprising:

a vehicle frame;

at least two wheels supporting the vehicle frame having a common rotational axis and a plurality of teeth attached thereto for compacting;

a first wheel cleaning assembly according to claim 11 associated with one of the at least two wheels, and a second wheel cleaning assembly according to claim 11 associated with the other of the at least two wheels, the mounting bar assemblies of each of the first and second wheel cleaning assemblies being oriented and extending out from the machine in a direction generally parallel to the rotational axis.

13. A wheel cleaning assembly comprising:

a cleaner finger assembly comprising:

a "C"-shaped support member having a top leg portion and a bottom leg portion joined together immovably by a vertical leg portion;

the top leg portion, bottom leg portion, and vertical leg portion each having, respectively, an inside and an outside surface;

the inside surface of the top leg portion and the inside surface of the bottom leg portion arranged to face one another and spaced from one another to create a space therebetween for accepting a mounting bar;

a space being defined by the inside surface of the top leg portion, the inside surface of the bottom leg portion, and the inside surface of the vertical leg portion, the space being open opposite the inside surface of the vertical leg portion for insertion of a mounting bar; and a single cleaner finger immovably attached to the support member.

14. A wheel cleaning assembly according to claim 13:

wherein the top leg portion and the bottom leg portion each have through mounting apertures defined therein.

15. A wheel cleaning assembly according to claim 13 further comprising:

a mounting bar adapted for extending out in proximity to a wheel of a compacting machine wherein the cleaner finger assembly is attached to the mounting bar and adapted to remove debris from between the teeth of a compacting machine.

16. A wheel cleaning assembly for a compacting machine wherein a cleaner finger is adapted to break away under an excessive force to protect other components of the assembly, the assembly comprising:

a mounting bar assembly adapted for extending out in proximity to a wheel of a compacting machine;

the mounting bar assembly mounting a plurality of cleaner finger assemblies;

at least one of the cleaner finger assemblies comprising a support member and a cleaner finger positioned to clean debris from the wheel;

wherein the cleaner finger is immovably attached to the support member with a weld, and the support member is mechanically attached to the mounting bar assembly with at least one mechanical fastener; and wherein the cleaner finger will break the immovable attachment to the support member at the weld under an excessive load applied to the cleaner finger before the support member breaks the mechanical attachment to the mounting bar assembly at the at least one mechanical fastener in order to protect the wheel cleaning assembly from damage.

17. A wheel cleaning assembly according to claim 16 wherein the support member is "C"-shaped having a middle leg portion attached between a top leg portion and a bottom leg portion, a space defined between the top leg portion and the bottom leg portion, and the mounting bar assembly positioned in the space.

18. A wheel cleaning assembly according to claim 17 wherein the weld is between the support member and the middle leg portion.

19. A wheel cleaning assembly according to claim 18 wherein the mounting bar assembly comprises:

a bar adapted to attach to and extend out from a compacting machine, the bar having a through aperture formed therein; and a mounting block positioned inside the aperture; and wherein the support member is mechanically attached to the mounting bar assembly with at least one mechanical fastener that attaches to the mounting block.

20. A wheel cleaning assembly for a compacting machine comprising:

a bar adapted for extending out longitudinally in proximity to a wheel of a compacting machine;

the bar having a tubular construction with a hollow space extending in the longitudinal direction of the bar surrounded laterally by walls of the bar, and a through hole formed in the lateral direction through the walls of the bar;

a mounting block with a first end and a second end opposite the first end, the mounting block positioned in the through hole of the bar such that each of the first end and the second end extends out from the hole;

a cleaner finger assembly comprising a cleaner finger for cleaning debris from the wheel; and wherein the cleaner finger assembly is mechanically attached to the mounting block with at least one removable mechanical fastener.

* * * * *

UNITED STATES PATENT AND TRADEMARK OFFICE

CERTIFICATE OF CORRECTION

PATENT NO. : 7,163,354 B2
APPLICATION NO. : 10/318339
DATED : January 16, 2007
INVENTOR(S) : Christopher M. Runestad It is certified that error appears in the above-identified patent and that said Letters Patent is hereby corrected as shown below:

On the Title Page:

On the Title page, in field (54), in Title, in Column 1, Lines 1-2 delete "AND MOUNTING FOR SAME" and insert --FOR A COMPACTOR--

In the Specification:

In Column 1, Lines 1-2, delete "AND MOUNTING FOR SAME" and insert --FOR A COMPACTOR--

In the Claims:

In Column 6, Line 29, in Claim 15, delete "13" and insert --14--

Signed and Sealed this

Eighteenth Day of August, 2009

David J. Kappos

David J. Kappos
*Director of the United States Patent and Trademark Office*